US005225305A

United States Patent [19]

Kiyoyanagi et al.

[11] Patent Number: 5,225,305

[45] Date of Patent: Jul. 6, 1993

[54] ELECTROPHOTOGRAPHIC TONER

[75] Inventors: Tadayuki Kiyoyanagi, Urawa; Junko Yamamoto, Tokyo; Shigeo Yamamura, Omiya, all of Japan

[73] Assignee: Nippon Kayaku Kabushiki Kaisha, Tokyo, Japan

[21] Appl. No.: 750,622

[22] Filed: Aug. 27, 1991

[30] Foreign Application Priority Data

Aug. 29, 1990 [JP] Japan ..... 2-225112

[51] Int. Cl.[5] ..... G03G 9/00

[52] U.S. Cl. ..... 430/110; 430/109

[58] Field of Search ..... 430/109, 110

[56] References Cited

U.S. PATENT DOCUMENTS 4,837,394 6/1989 Alexandrovich et al. ..... 430/110

OTHER PUBLICATIONS

The Abstract of Japanese Patent Application Laid-Open (Kokai) No. 61-156142.

The Abstract of Japanese Patent Application Laid-Open (Kokai) No. 61-217064.

The Abstract of Japanese Patent Application Laid-Open (Kokai) No. 61-213856.

The Abstract of Japanese Patent Application Laid-Open (Kokai) No. 2-18568.

*Primary Examiner*—Marion E. McCamish

*Assistant Examiner*—Stephen C. Crossan

*Attorney, Agent, or Firm*—Nields & Lemack

[57] ABSTRACT

An electrophotographic toner containing a specific compound as the charge control agent is described. The electrophotographic toner according to the present invention have a sharper distribution of the amount of electrification and better moisture resistance and time stability than those of a toner wherein a conventional charge control agent is used. Therefore it can provide an image having a very high gradation and has a very high capability of repeatedly forming an image. Since the charge control agent, as such, is essentially colorless, a colorant can freely be selected according to a hue required of a color toner and the toner is not detrimental to the hue inherent in a dye and a pigment.

6 Claims, No Drawings

ELECTROPHOTOGRAPHIC TONER

BACKGROUND OF THE INVENTION

The present invention relates to a toner used for developing an electrostatic latent image in an electrophotography, an electrostatic recording, etc.

An imaging process wherein use is made of static electricity, such as electrostatic recording or electrostatic photography, comprises the step of forming an electrostatic latent image and the step of visualizing the electrostatic latent image. The electrostatic latent image is formed by light signal on a photosensitive material prepared by coating a base material such as aluminum and paper with a photoconductive material such as phthalocyanine pigment, selenium, cadmium sulfide and amorphous silicon. The electrostatic latent image thus formed is visualized by subjecting colored fine particles called toner having a particle diameter regulated to 5 to 50 μm to contact electrification with a charge carrier such as iron powder and ferrite powder (two-component development) or direct electrification (one-component development) and then allowing the charged toner to act on the electrostatic latent image. It is necessary to impart a charge corresponding to the polarity of the electrostatic latent image formed on the photoconductive material, that is, either a positive charge or a negative charge, to the toner.

The colored fine particle called toner generally comprises a binder resin and a colorant as the indispensable components and an optional component such as a magnetic powder. An electric charge can be imparted to the toner through the utilization of an electrification property of the binder resin per se without using any charge control agent. In this method, however, no good image quality can be obtained due to poor time stability and poor moisture resistance. For this reason, a charge control agent is usually added for the purpose of retaining and controlling the electric charge.

Quality characteristics required of the toner include excellent electrifiability, fluidity and fixing property. These quality characteristics are greatly affected by the charge control agent used for the toner.

Examples of the conventional charge control agent added to the toner include (1) colored negative charge control agents such as 2:1 metallic complex salt dyes (Japanese Patent Publication (KOKOKU) Nos. 26478/1970 and 201531/1966) and phthalocyanine pigments (Japanese Patent Application Laid-Open (KOKAI) No. 45931/1977), and colorless charge control agents such as those described in Japanese Patent Publication (KOKOKU) No. 7384/1984 or Japanese Patent Application Laid-Open (KOKAI) No. 3149/1986 and (2) positive charge control agents such as nigrosine dyes, various quaternary ammonium salts (Bulletin of the Institute of Electrostatics Japan, vol. 4, No. 3, P. 114 (1980)) and organotin compounds such as dibutyltin oxide (Japanese Patent Publication (KOKOKU) No. 29704/1982). The toners containing these compounds as the charge control agent, however, do not sufficiently satisfy the quality characteristics requirements for the toner, such as electrifiability and time stability. For example, although the amount of electrification of the toner containing a 2:1 metallic complex salt dye known as the negative charge control agent is on a fair level, this dye is disadvantageously poor in the dispersibility in a binder resin on the whole. For this reason, the dye is not homogeneously dispersed in the binder resin, and the distribution of the amount of charge extremely lacks in sharpness. The resultant image has a low gradation and is poor in the image forming capability. Further, this dye is disadvantageous because it cannot be used but for a toner having a shade of color limited to black or blackish hue. The use of this dye for a color toner is detrimental to the brightness of the colorant.

Examples of the nearly colorless negative charge control agent include a metal complex of an aromatic dicarboxylic acid (Japanese Patent Publication (KOKOKU) No. 7384/1984). This charge control agent, however, is disadvantageous in that it cannot become completely colorless and the dispersibility is poor. Examples of the colorless negative charge control agent include a compound disclosed in Japanese Patent Application Laid-Open (KOKAI) No. 3149/1986. This compound, however, is disadvantageous in that it is difficult to produce a toner having a good stability because the heat stability during the production of the toner is poor due to a low melting point of this compound.

The nigrosine dye known as the positive charge control agent as well is colored and therefore can be used only for a toner having a color limited to black or blackish color and poor in the time stability in continuous copying. The quaternary ammonium salt, when incorporated in a toner, has a poor time stability attributable to its insufficient moisture resistance and therefore cannot provide an image having a good quality in repeated use. Thus, the conventional charge control agents do not sufficiently satisfy the quality characteristics requirements for the toner.

SUMMARY OF THE INVENTION

An object of the present invention is to provide a colorless positive charge control agent having a good dispersibility in a binder resin, no susceptibility to temperature change and humidity change and a high capability of controlling electrification and to provide a positive charge toner having excellent stability in the rise of the charge and environmental resistance and capable of providing an image having a high gradation.

The present inventors have made an intensive effort to solve the above-described problem and, as a result, have found that the incorporation of at least one compound represented by the following formula (1) in a toner makes the charge distribution of the toner sharp and consequently remarkably improves the electrification characteristics. The present invention has accomplished based on this finding.

$$(A_1)^{\ominus}X_1^{\oplus}-Y_1-Z-Y_2-X_2^{\oplus}(A_2)^{\ominus} \quad (1)$$

wherein $X_1^{\oplus}$ and $X_2^{\oplus}$ independently represent $$-\overset{\oplus}{\underset{\underset{R_3}{|}}{\overset{\overset{R_1}{|}}{P}}}-R_2$$

wherein $R_1$, $R_2$ and $R_3$ independently represent a substituted or unsubstituted alkyl group, a substituted or unsubstituted cycloalkyl group, a substituted or unsubstituted alkenyl group, a substituted or unsubstituted alkynyl group, a substituted or unsubstituted aryl group or a substituted or unsubstituted aralkyl group, $R_1$ and $R_2$ may combine together to represent a divalent group; $Y_1$ and $Y_2$ independently represent a direct bond, an alkylene group having 1 to 10 carbon atoms or an alkenylene group having 3 to 10 carbon atoms; Z represents a divalent aromatic group, a divalent heterocyclic group, —$NR_4$—, —$N(R_4)CO$— wherein $R_4$ represents a hydrogen atom, a substituted or unsubstituted alkyl group, a substituted or unsubstituted aryl group or a substituted or unsubstituted aralkyl group, —O—, —$OCH_2CH_2O$— or a substituted alkylene group; and $(A_1)^{\ominus}$ *and* $(A_2)^{\ominus}$ independently represent an anion.

DETAILED DESCRIPTION OF THE INVENTION

In the formula (1), preferred group for the respective $R_1$, $R_2$ and $R_3$ may include a substituted or unsubstituted $C_1$–$C_{12}$ alkyl group, a substituted or unsubstituted $C_6$ cycloalkyl group, a substituted or unsubstituted $C_3$–$C_4$ alkenyl group, a substituted or unsubstituted $C_2$–$C_4$ alkynyl group, a substituted or unsubstituted aryl group such as phenyl and naphthyl, and a substituted or unsubstituted aralkyl group such as benzyl, a-methylbenzyl, diphenylmethyl and phenethyl. As preferred substituents for each of the groups described above, a $C_1$–$C_4$ alkoxy group such as methoxy and ethoxy, an aryloxy group such as phenoxy, amino group, di($C_1$–$C_4$ alkyl)amino group such as dimethylamino and diethylamino, a $C_1$–$C_4$ alkyl such as methyl, ethyl, propyl and butyl, a halogen atom such as fluorine, chlorine and bromine, an aryl group such as phenyl and methylphenyl, a hydroxyl group and a cyano group may be included.

$R_1$ and $R_2$ may combined together to represent a divalent group. As a preferred divalent group, a $C_5$ alkylene group and a biphenylene group may be exemplified.

The compound represented by the formula (1) acts as a positive charge control agent. This compound has a good compatibility with a binder resin, and a toner containing this compound has a high specific electrification amount and a good time stability and therefore can stably provide a clear image in the image formation through electrostatic recording even after storage for a long period of time. A particularly suitable toner is one wherein a compound of a symmetrical form, i.e., a compound of the formula (1) wherein $(A_1)^{\ominus}=(A_2)^{\ominus}$, $X_1^{\oplus}=X_2^{\oplus}$ and $Y_1=Y_2$, is used as the charge control agent.

Specific examples of the compound represented by the formula (1) which may be incorporated as a charge control agent in a toner include those given in Table 1, though the charge control agent is not limited to these compounds only.

TABLE 1

| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 1 | $Br^{\ominus}$ | $(H_5C_2)_3P^{\oplus}$ | $-CH_2-$ | 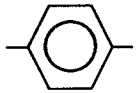 | $-CH_2-$ | $-P^{\oplus}(C_2H_5)_3$ | $Br^{\ominus}$ |
| 2 | $Cl^{\ominus}$ | $(H_{11}C_5)_3P^{\oplus}-$ | $\leftarrow CH_2 \rightarrow_2$ | 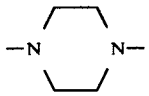 | $\leftarrow CH_2 \rightarrow_2$ | $-P^{\oplus}(C_5H_{11})_3$ | $Cl^{\ominus}$ |
| 3 | $Mo_0O_{4/2}^{\ominus}$ | $(H_{17}C_8)_3P^{\oplus}-$ | $-CH_2-$ | 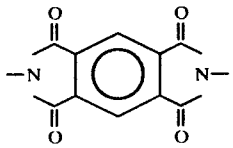 | $-CH_2-$ | $-P^{\oplus}(C_8H_{17})_3$ | $Mo_0O_{4/2}^{\ominus}$ |
| 4 | $Br^{\ominus}$ | $(H_{17}C_8)_3P^{\oplus}-$ | $-CH_2-$ | 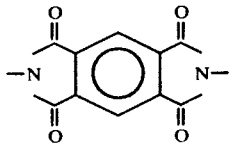 | $-CH_2-$ | $-P^{\oplus}(C_8H_{17})_3$ | $Br^{\ominus}$ |
| 5 | $I^{\ominus}$ | $(CH_3OCH_2CH_2)_3P^{\oplus}-$ | $-CH_2-$ | 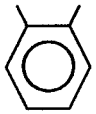 | $-CH_2-$ | $-P^{\oplus}(CH_2CH_2OCH_3)_3$ | $I^{\ominus}$ |
| 6 | $Cl^{\ominus}$ | $[(C_2H_5)_2CHCH_2]_3P^{\oplus}-$ | $-CH_2-$ | 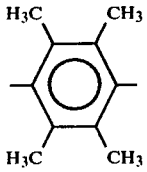 | $-CH_2-$ | $-P^{\oplus}[CH_2CH(C_2H_5)_2]_3$ | $Cl^{\ominus}$ |

TABLE 1-continued

| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 7 | 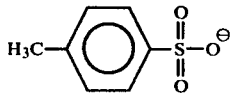 | 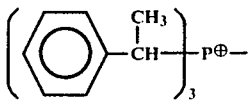 | $-CH_2-$ | 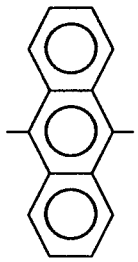 | $-CH_2-$ | 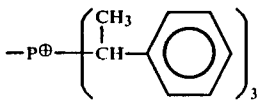 | 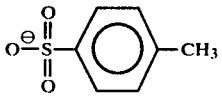 |
| 8 | $C_2H_5SO_3^{\ominus}$ | $[CH_3(CH_2)_{22}]_3P^{\oplus}-$ | $+CH_2\rangle_3$ | 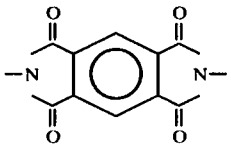 | $+CH_2\rangle_3$ | $-P^{\oplus}[+(CH_2)_{11}CH_3]_3$ | $C_2H_5SO_3^{\ominus}$ |
| 9 | $PF_6^{\ominus}$ | $[(CH_3)_2CHCH_2CH_2]_3P^{\oplus}-$ | $-CH_2-$ | 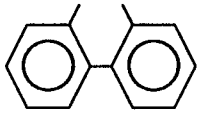 | $-CH_2-$ | $-P^{\oplus}[+(CH_2CH_2CH(CH_3)_2]_3$ | $PF_6^{\ominus}$ |
| 10 | $PF_6^{\ominus}$ | 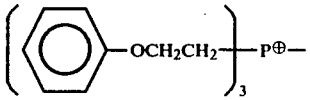 | $+CH_2\rangle_2$ | 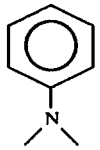 | $+CH_2\rangle_2$ | 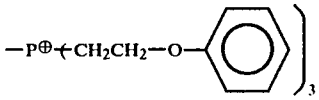 | $PF_6^{\ominus}$ |
| 11 | $ClO_4^{\ominus}$ | $((C_2H_5)_2NCH_2CH_2CH_2)_3P^{\oplus}-$ | $+CH_2\rangle_2$ | 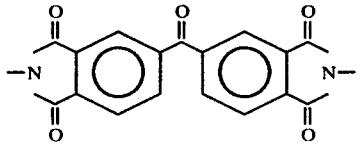 | $+CH_2\rangle_2$ | $-P^{\oplus}+CH_2CH_2CH_2N(C_2H_5)_2)_3$ | $ClO_4^{\ominus}$ |
| 12 | $BF_4^{\ominus}$ | 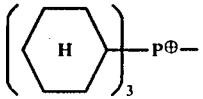 | $+CH_2\rangle_3$ | 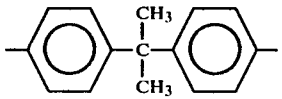 | $+CH_2\rangle_3$ | 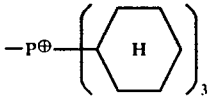 | $BF_4^{\ominus}$ |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 13 | $Br^{\ominus}$ | 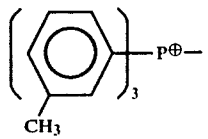 | $-CH_2-$ | 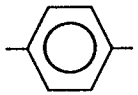 | $-CH_2-$ | 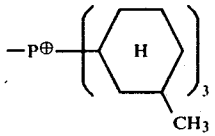 | $Br^{\ominus}$ |
| 14 | $Ph_4B^{\ominus}$ | 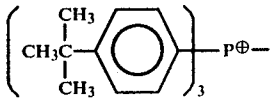 | $+CH_2\rightarrow_3$ | 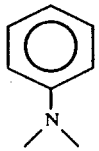 | $+CH_2\rightarrow_3$ | 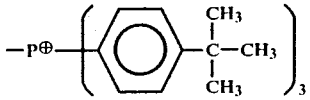 | $Ph_4B^{\ominus}$ |
| 15 | $SO_4^{2-}/2$ | 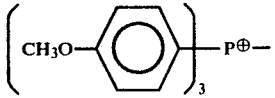 | $-CH_2-$ | 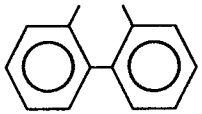 | $-CH_2-$ | 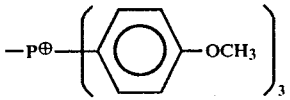 | $SO_4^{2-}/2$ |
| 16 | $I^{\ominus}$ | 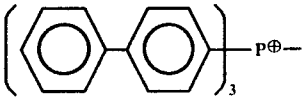 | $+CH_2\rightarrow_8$ | 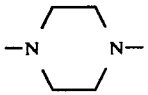 | $+CH_2\rightarrow_8$ | 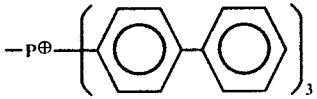 | $I^{\ominus}$ |
| 17 | $PF_6^{\ominus}$ | 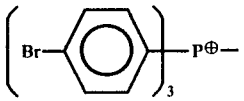 | $+CH_2\rightarrow_5$ | 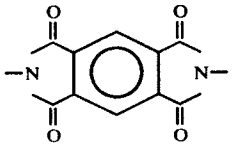 | $+CH_2\rightarrow_5$ | 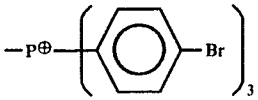 | $PF_6^{\ominus}$ |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 18 | $ClO_4^{\ominus}$ | 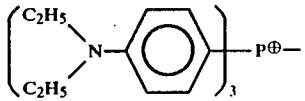 | $-CH_2-$ | 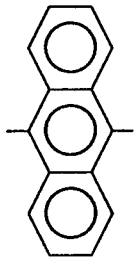 | $-CH_2-$ | 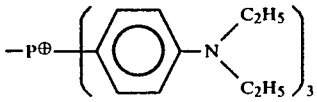 | $ClO_4^{\ominus}$ |
| 19 | $SbF_6^{\ominus}$ | 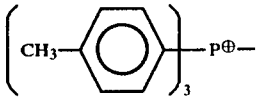 | $-CH_2-$ | 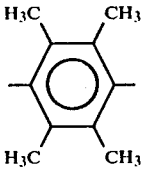 | $-CH_2-$ | 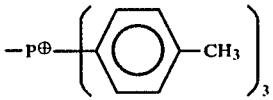 | $SbF_6^{\ominus}$ |
| 20 | 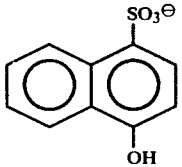 | 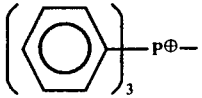 | $-CH_2-$ | 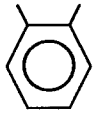 | $-CH_2-$ | 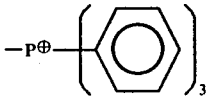 | 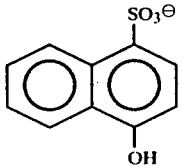 |
| 21 | 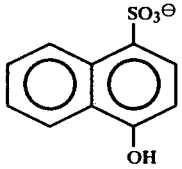 | 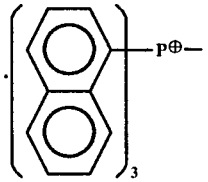 | $-CH_2-$ | 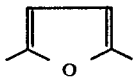 | $-CH_2-$ | 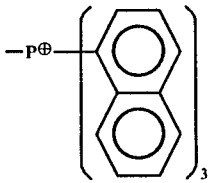 | 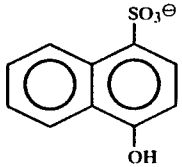 |
| 22 | 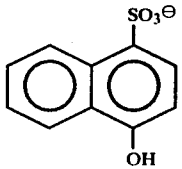 | 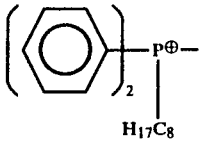 | $-CH_2-$ | 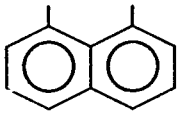 | $-CH_2-$ | 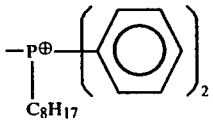 | 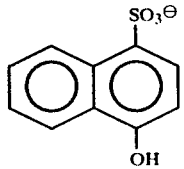 |

TABLE 1-continued

| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 23 | 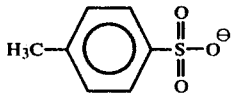 | 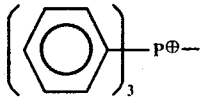 | $\leftarrow CH_2 \rightarrow_2$ | 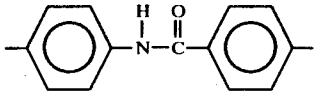 | $\leftarrow CH_2 \rightarrow_2$ | 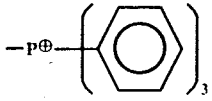 | 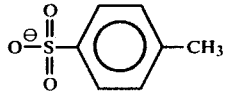 |
| 24 | 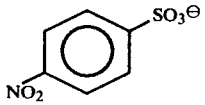 | 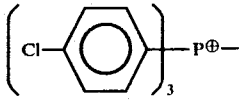 | $-CH_2-$ | 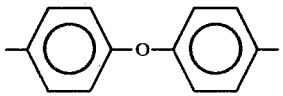 | $-CH_2-$ | 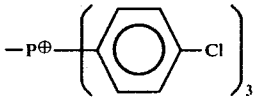 | 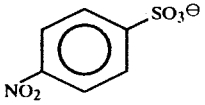 |
| 25 | $PF_6^{\ominus}$ | 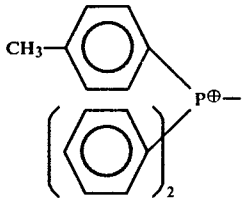 | $\leftarrow CH_2 \rightarrow_3$ | 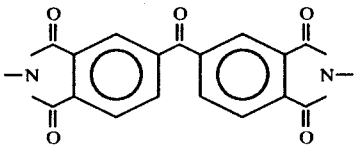 | $\leftarrow CH_2 \rightarrow_3$ | 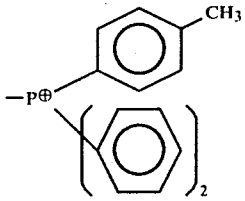 | $PF_6^{\ominus}$ |
| 26 | $Br^{\ominus}$ | 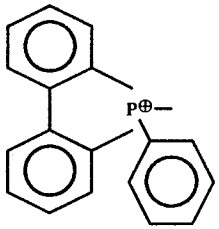 | $-CH_2-$ | 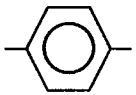 | $-CH_2-$ | 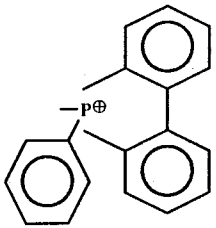 | $Br^{\ominus}$ |
| 27 | $Cl^{\ominus}$ | 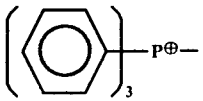 | $\leftarrow CH_2 \rightarrow_3$ | 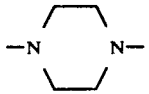 | $\leftarrow CH_2 \rightarrow_3$ | 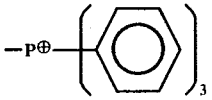 | $Br^{\ominus}$ |
| 28 | 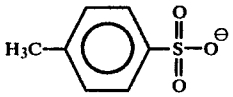 | " | $\leftarrow CH_2 \rightarrow_3$ | 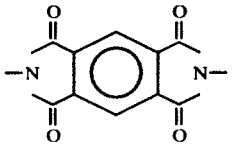 | $\leftarrow CH_2 \rightarrow_3$ | " | 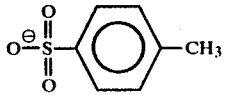 |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 29 | $BF_4^{\ominus}$ | " | $-CH_2-$ | 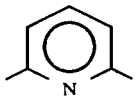 | $-CH_2-$ | " | $BF_4^{\ominus}$ |
| 30 | $Br^{\ominus}$ | 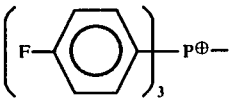 | $+CH_2\rightarrow_2$ | 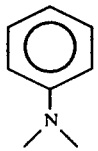 | $+CH_2\rightarrow_2$ | 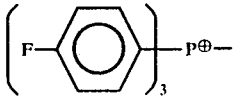 | $Br^{\ominus}$ |
| 31 | $CH_3SO_3^{\ominus}$ | 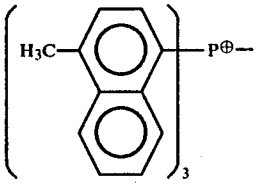 | $+CH_2\rightarrow_2$ | $-OCH_2CH_2O-$ | $+CH_2\rightarrow_2$ | 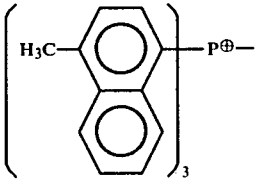 | $CH_3SO_3^{\ominus}$ |
| 32 | 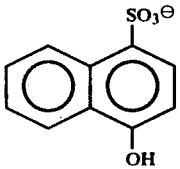 | 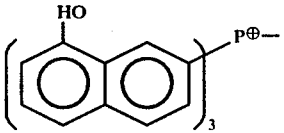 | $-CH_2-$ | 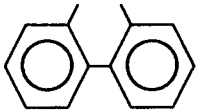 | $-CH_2-$ | 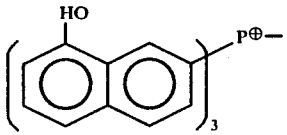 | 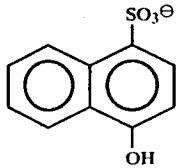 |
| 33 | 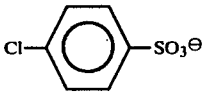 | 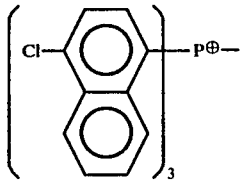 | $+CH_2\rightarrow_4$ | 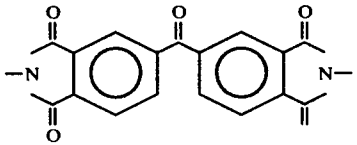 | $+CH_2\rightarrow_4$ | 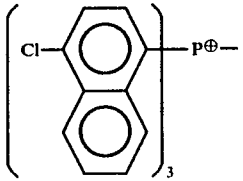 | 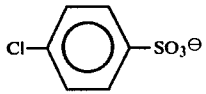 |
| 34 | $PF_6^{\ominus}$ | 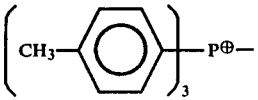 | $-CH_2-$ | 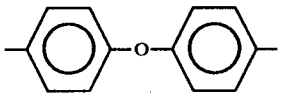 | $-CH_2-$ | 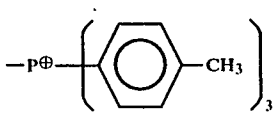 | $PF_6^{\ominus}$ |

TABLE 1-continued

| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 35 | $PO_4^{3-}/3$ | " | $-CH_2-$ | 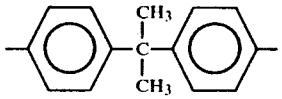 | — | " | $PO_4^{3-}/3$ |
| 36 | $Br^{\ominus}$ | 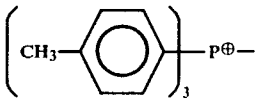 | $\leftarrow CH_2 \rightarrow_4$ | 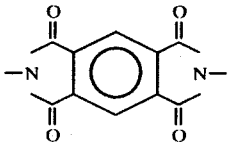 | $\leftarrow CH_2 \rightarrow_4$ | 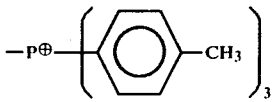 | $Br^{\ominus}$ |
| 37 | 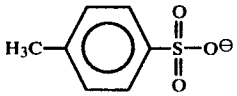 | " | $\leftarrow CH_2 \rightarrow_{10}$ | 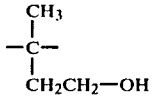 | $\leftarrow CH_2 \rightarrow_{10}$ | " | 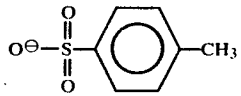 |
| 38 | $PF_6^{\ominus}$ | 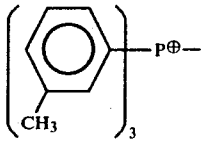 | $\leftarrow CH_2 \rightarrow_2$ | 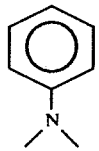 | $\leftarrow CH_2 \rightarrow_2$ | 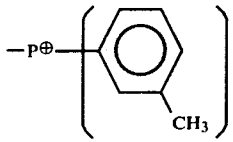 | $PF_6^{\ominus}$ |
| 39 | $CH_3CO_2^{\ominus}$ | " | $-CH_2-$ | 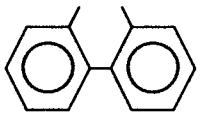 | $-CH_2-$ | " | $CH_3CO_2^{\ominus}$ |
| 40 | $BF_4^{\ominus}$ | " | $\leftarrow CH_2 \rightarrow_2$ | 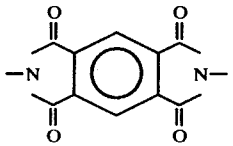 | $\leftarrow CH_2 \rightarrow_2$ | " | $BF_4^{\ominus}$ |
| 41 | $CF_3SO_3^{\ominus}$ | " | $-CH_2-$ | 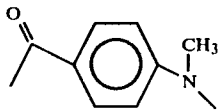 | $\leftarrow CH_2 \rightarrow_5$ | " | $CF_3SO_3^{\ominus}$ |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 42 | $Br^{\ominus}$ | 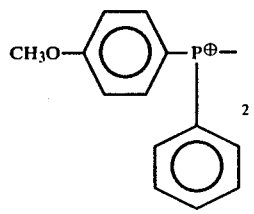 | $-CH_2-$ | 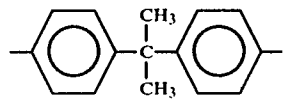 | $-CH_2-$ | 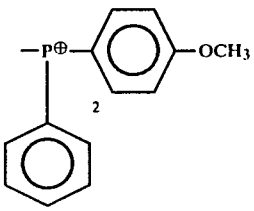 | $Br^{\ominus}$ |
| 43 | $I^{\ominus}$ | 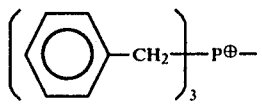 | $-CH_2-$ | 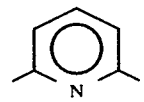 | $-CH_2-$ | 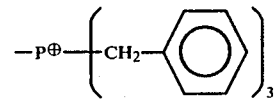 | $I^{\ominus}$ |
| 44 | $Br^{\ominus}$ | 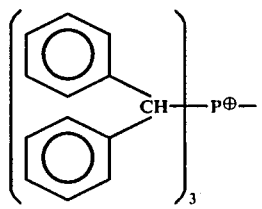 | $-CH_2-$ | 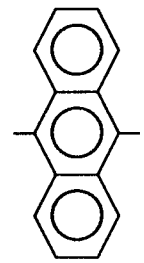 | $-CH_2-$ | 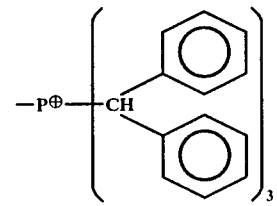 | $Br^{\ominus}$ |
| 45 | 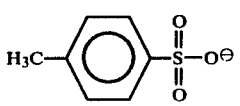 | 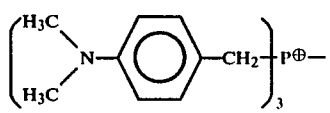 | $-CH_2-$ | 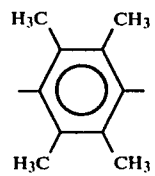 | $-CH_2-$ | 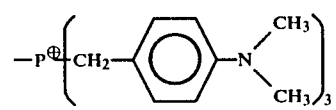 | 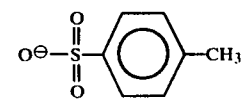 |
| 46 | $PF_6^{\ominus}$ | 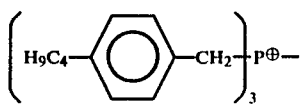 | $-CH_2-$ | 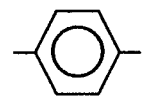 | $-CH_2-$ | 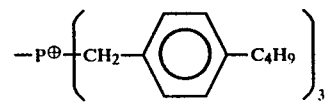 | $PF_6^{\ominus}$ |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 47 | $BF_4^{\ominus}$ | 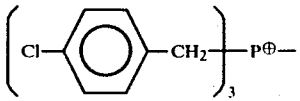 | $-(CH_2)_2-$ | 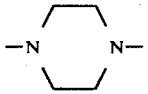 | $-(CH_2)_2-$ | 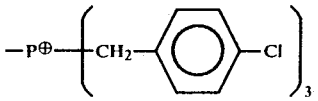 | $BF_4^{\ominus}$ |
| 48 | 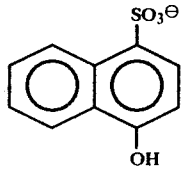 | 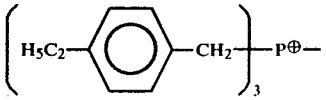 | $-(CH_2)_4-$ | 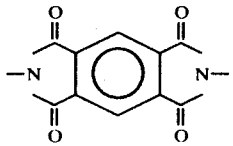 | $-(CH_2)_4-$ | 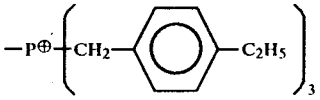 | 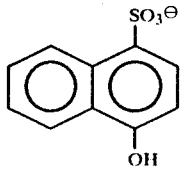 |
| 49 | $CH_3SO_3^{\ominus}$ | 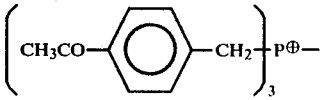 | $-(CH_2)_5-$ | 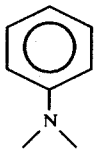 | $-(CH_2)_5-$ | 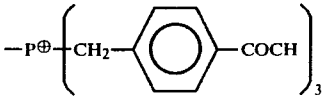 | $CH_3SO_3^{\ominus}$ |
| 50 | $ClO_4^{\ominus}$ | 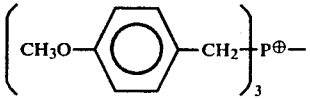 | $-CH_2-$ | 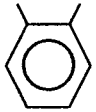 | $-CH_2-$ | 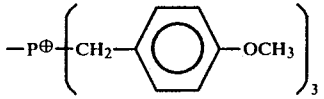 | $ClO_4^{\ominus}$ |
| 51 | $SO_4^{2-}/2$ | 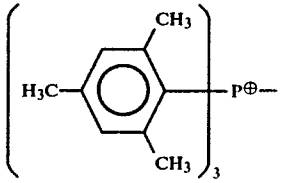 | $-(CH_2)_3-$ | 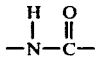 | $-(CH_2)_6-$ | 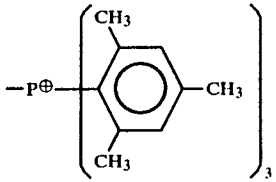 | $SO_4^{2-}/2$ |
| 52 | $BF_4^{\ominus}$ | 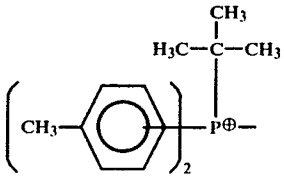 | $-(CH_2)_2-$ | 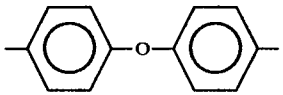 | $-(CH_2)_2-$ | 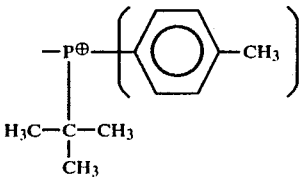 | $BF_4^{\ominus}$ |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 53 | $Br^{\ominus}$ | 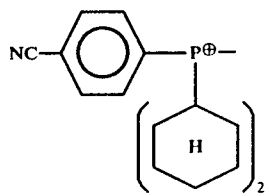 | $-CH_2-$ | 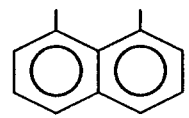 | $-CH_2-$ | 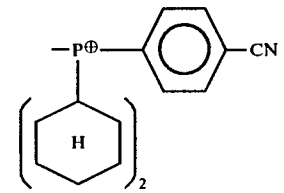 | $Br^{\ominus}$ |
| 54 | $SbF_6^{\ominus}$ | 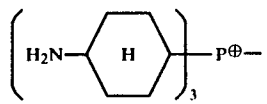 | $-CH_2-$ | 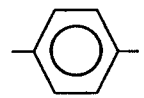 | $-CH_2-$ | 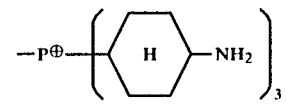 | $SbF_6^{\ominus}$ |
| 55 | $ClO_4^{\ominus}$ | 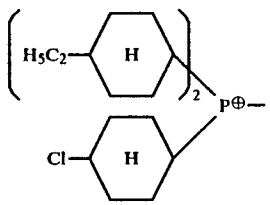 | $-CH_2-$ | 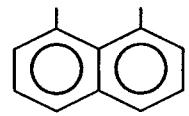 | $-CH_2-$ | 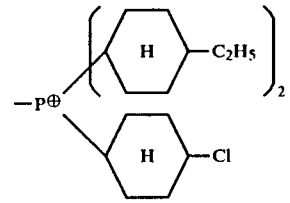 | $ClO_4^{\ominus}$ |
| 56 | $BF_4^{\ominus}$ | 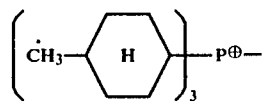 | $-(CH_2)_2-$ | 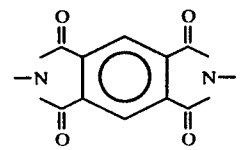 | $-(CH_2)_2-$ | 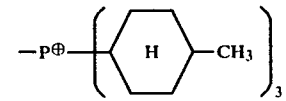 | $BF_4^{\ominus}$ |
| 57 | 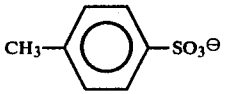 | 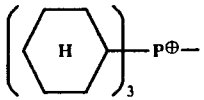 | $-(CH_2)_4-$ | 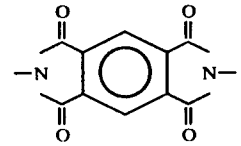 | $-(CH_2)_4-$ | 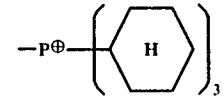 | 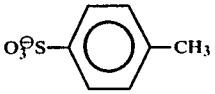 |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 58 | $I^{\ominus}$ | 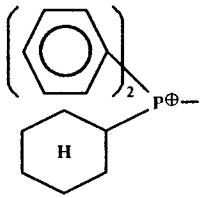 | $-CH_2-$ | 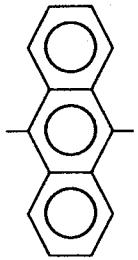 | $-CH_2-$ | 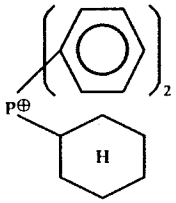 | $I^{\ominus}$ |
| 59 | $SbF_6^{\ominus}$ | 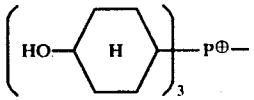 | $-CH_2-$ | 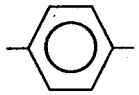 | $-CH_2-$ | 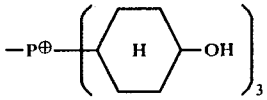 | $SbF_6^{\ominus}$ |
| 60 | $SO_4^{2-}/2$ | 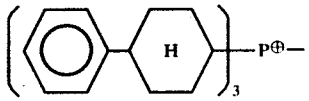 | $-CH_2-$ | 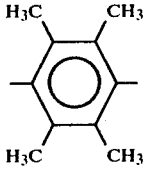 | $-CH_2-$ | 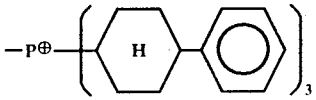 | $SO_4^{2-}/2$ |
| 61 | $CH_3SO_3^{\ominus}$ | 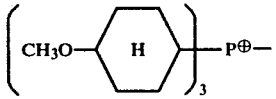 | $-CH_2-$ | 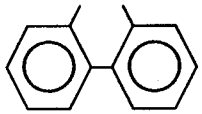 | $-CH_2-$ | 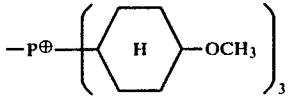 | $CH_3SO_3^{\ominus}$ |
| 62 | $Br^{\ominus}$ | 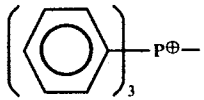 | $-(CH_2)_2-$ | 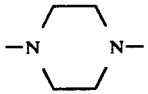 | $-(CH_2)_2-$ | 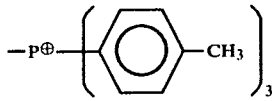 | $Br^{\ominus}$ |
| 63 | 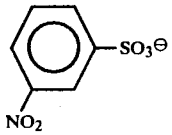 | 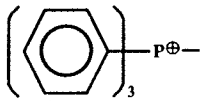 | $-(CH_2)_6-$ | 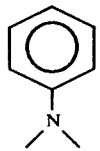 | $-(CH_2)_6-$ | 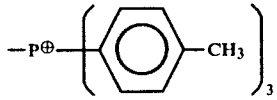 | 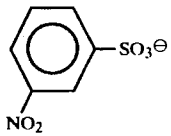 |

TABLE 1-continued

| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 64 | 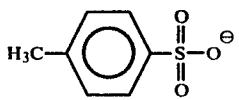 | 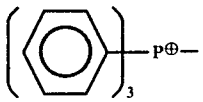 | $\leftarrow CH_2 \rightarrow_4$ | 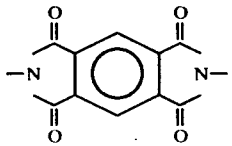 | $\leftarrow CH_2 \rightarrow_4$ | $-P^{\oplus}\leftarrow C_8H_{16}\rightarrow_3$ | 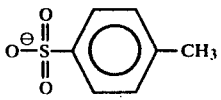 |
| 65 | $PF_6^{\ominus}$ | 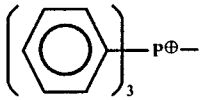 | $\leftarrow CH_2 \rightarrow_5$ | 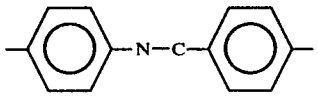 | $\leftarrow CH_2 \rightarrow_2$ | 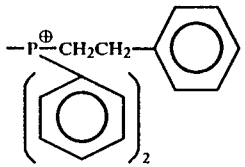 | $PF_6^{\ominus}$ |
| 66 | $CH_3SO_3^{\ominus}$ | 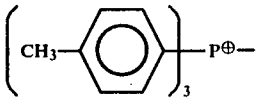 | $-CH_2-$ | 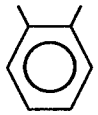 | $-CH_2-$ | 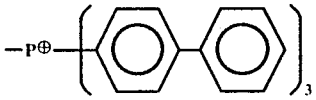 | $CH_3SO_3^{\ominus}$ |
| 67 | $Br^{\ominus}$ | 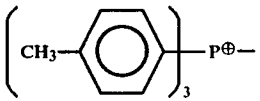 | $-CH_2-$ | 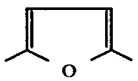 | $-CH_2-$ | 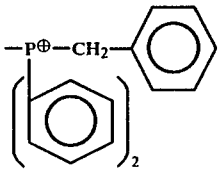 | $Br^{\ominus}$ |
| 68 | 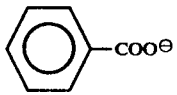 | 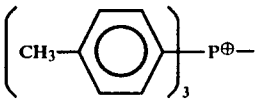 | $\leftarrow CH_2 \rightarrow_2$ | $-OCH_2CH_2O-$ | $\leftarrow CH_2 \rightarrow_2$ | 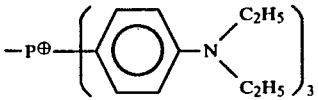 | 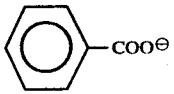 |
| 69 | $NO_3^{\ominus}$ | 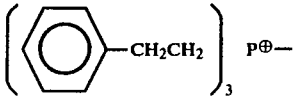 | $\leftarrow CH_2 \rightarrow_2$ | 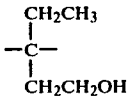 | $\leftarrow CH_2 \rightarrow_2$ | 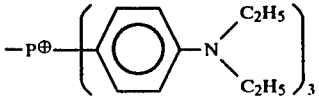 | $NO_3^{\ominus}$ |

TABLE 1-continued

| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 70 | $Br^{\ominus}$ | 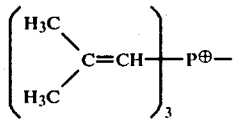 | $-CH_2-$ | 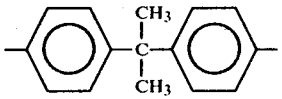 | $-CH_2-$ | 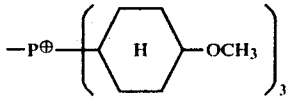 | $Br^{\ominus}$ |
| 71 | $I^{\ominus}$ | $(CH_3CH{=}CHCH_2)_3P^{\oplus}-$ | $\leftarrow CH_2\rightarrow_2$ | 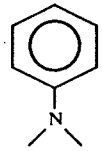 | $\leftarrow CH_2\rightarrow_2$ | 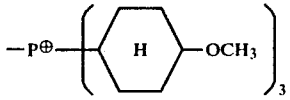 | $I^{\ominus}$ |
| 72 | $BF_4^{\ominus}$ | $(CH_2{=}CHCH_2)_3P^{\oplus}-$ | $\leftarrow CH_2\rightarrow_2$ | 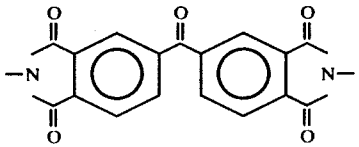 | $\leftarrow CH_2\rightarrow_2$ | $-P^{\oplus}(CH_2CH{=}CH_2)_3$ | $BF_4^{\ominus}$ |
| 73 | $PF_6^{\ominus}$ | 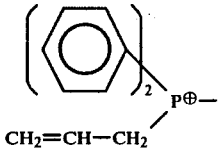 | $-CH_2-$ | 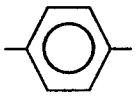 | $-CH_2-$ | 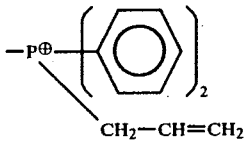 | $PF_6^{\ominus}$ |
| 74 | $Ph_4B^{\ominus}$ | $(CH_3C{\equiv}C-CH_2)_3P^{\oplus}-$ | $-CH_2-$ | 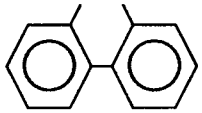 | $-CH_2-$ | $-P^{\oplus}(CH_2C{\equiv}CCH_3)_3$ | $Ph_4B^{\ominus}$ |
| 75 | 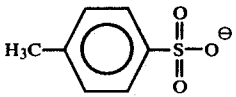 | 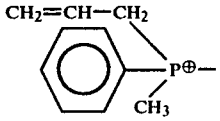 | $\leftarrow CH_2\rightarrow_4$ | 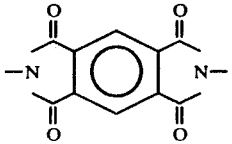 | $\leftarrow CH_2\rightarrow_4$ | 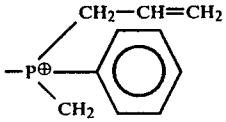 | 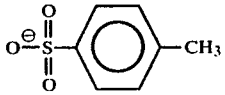 |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 76 | 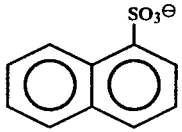 | 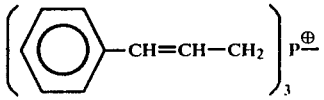 | $-CH_2-$ | 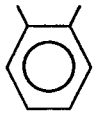 | $-CH_2-$ | 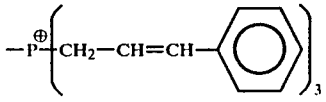 | 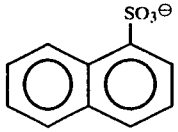 |
| 77 | $ClO_4^{\ominus}$ | 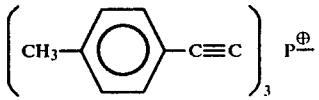 | $-(CH_2)_6-$ | 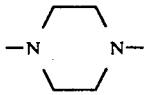 | $-(CH_2)_6-$ | 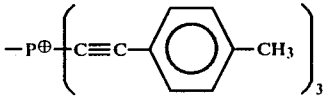 | $ClO_4^{\ominus}$ |
| 78 | $SO_4^{2\ominus}/2$ | $(CH_3OCH_2CH_2)_3P^{\oplus}-$ | $-CH_2-$ | 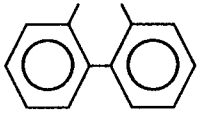 | $-CH_2-$ | 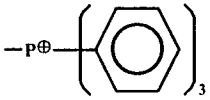 | $SO_4^{2\ominus}/2$ |
| 79 | $Br^{\ominus}$ | 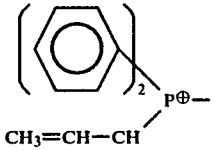 | $-CH_2-$ | 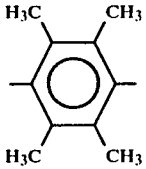 | $-CH_2-$ | 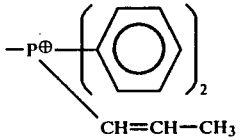 | $Br^{\ominus}$ |
| 80 | $Cl^{\ominus}$ | 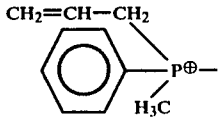 | $-(CH_2)_2-$ | $-OCH_2CH_2O-$ | $-(CH_2)_2-$ | 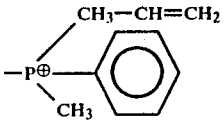 | $Cl^{\ominus}$ |
| 81 | $Br^{\ominus}$ | 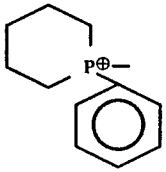 | $-(CH_2)_3-$ | 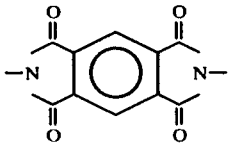 | $-(CH_2)_3-$ | 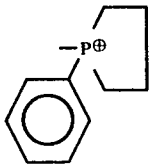 | $Br^{\ominus}$ |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 82 | $BF_4^{\ominus}$ | 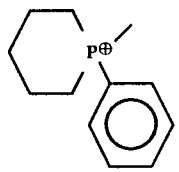 | $-CH_2-$ | 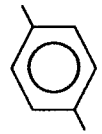 | $-CH_2-$ | 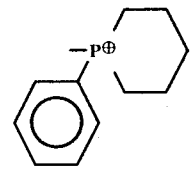 | $BF_4^{\ominus}$ |
| 83 | 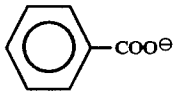 | 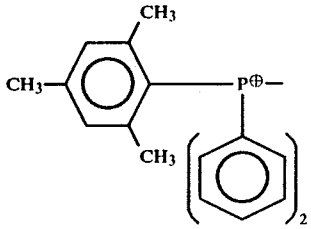 | $\leftarrow CH_2 \rightarrow_2$ | 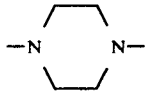 | $\leftarrow CH_2 \rightarrow_2$ | 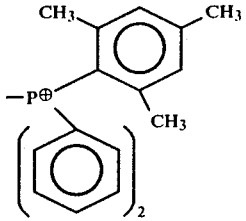 | 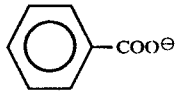 |
| 84 | 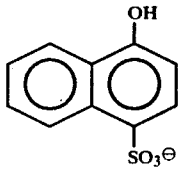 | 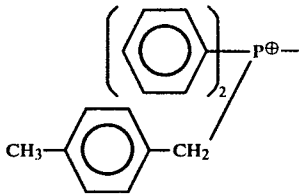 | $\leftarrow CH_2 \rightarrow_3$ | 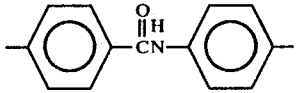 | $\leftarrow CH_2 \rightarrow_3$ | 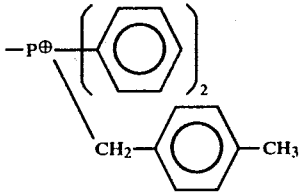 | 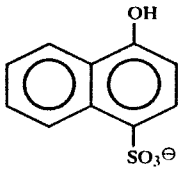 |
| 85 | $I^{\ominus}$ | 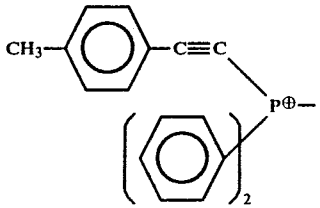 | $-CH_2-$ | 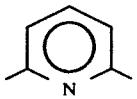 | $-CH_2-$ | 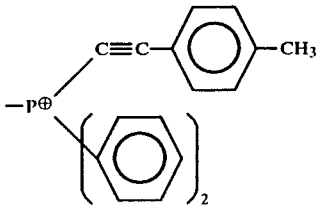 | $I^{\ominus}$ |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 86 | 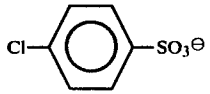 | 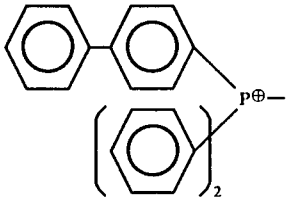 | $-CH_2-$ | 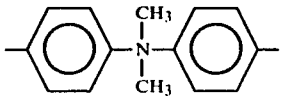 | $-CH_2-$ | 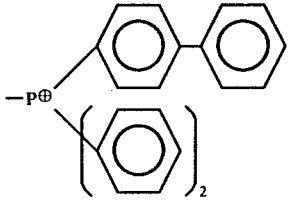 | 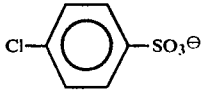 |
| 87 | $Br^{\ominus}$ | 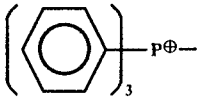 | $-CH_2-$ | 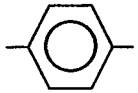 | $-CH_2-$ | 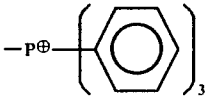 | $Br^{\ominus}$ |
| 88 | $Br^{\ominus}$ | 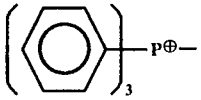 | $-CH_2-$ | 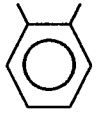 | $-CH_2-$ | 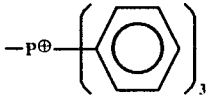 | $Br^{\ominus}$ |
| 89 | $Br^{\ominus}$ | 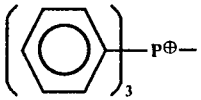 | $-CH_2-$ | 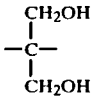 | $-CH_2-$ | 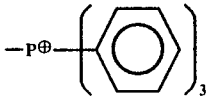 | $Br^{\ominus}$ |
| 90 | $Cl^{\ominus}$ | 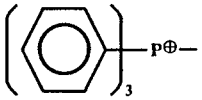 | $-CH_2-$ | $-CH_2-O-CH_2-$ | $-CH_2-$ | 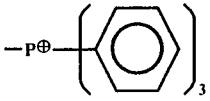 | $Cl^{\ominus}$ |
| 91 | $Br^{\ominus}$ | 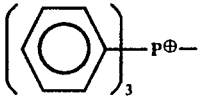 | — | $-CH=CH-CH=CH-$ | — | 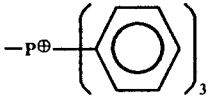 | $Br^{\ominus}$ |
| 92 | $BF_4^{\ominus}$ | 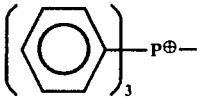 | $-CH_2-$ | 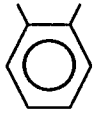 | $-CH_2-$ | 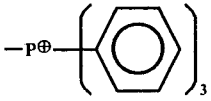 | $BF_4^{\ominus}$ |

TABLE 1-continued
| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 93 | $Br^{\ominus}$ | 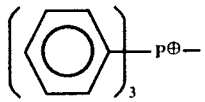 | $-(CH_2)_2-$ | 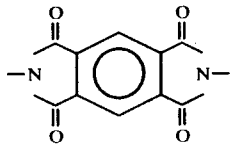 | $-(CH_2)_2-$ | 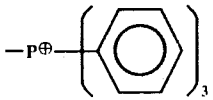 | $Br^{\ominus}$ |
| 94 | $Br^{\ominus}$ | 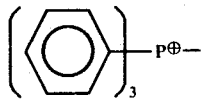 | $-CH_2-$ | 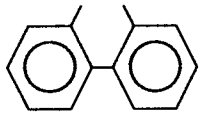 | $-CH_2-$ | 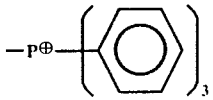 | $Br^{\ominus}$ |
| 95 | $Br^{\ominus}$ | 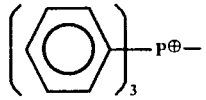 | $-(CH_2)_2-$ | 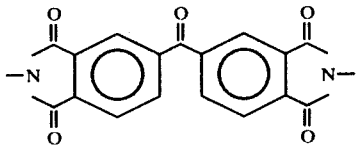 | $-(CH_2)_2-$ | 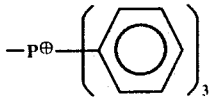 | $Br^{\ominus}$ |
| 96 | $Br^{\ominus}$ | 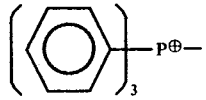 | — | 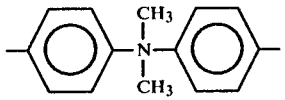 | — | 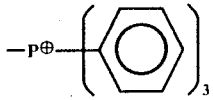 | $Br^{\ominus}$ |
| 97 | 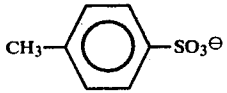 | 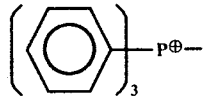 | $-CH_2-$ | 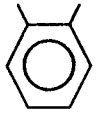 | $-CH_2-$ | 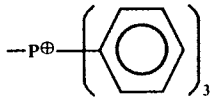 | 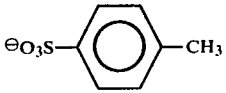 |
| 98 | $I^{\ominus}$ | 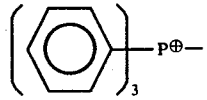 | $-(CH_2)_2-$ | 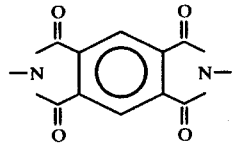 | $-(CH_2)-$ | 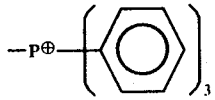 | $I^{\ominus}$ |
| 99 | 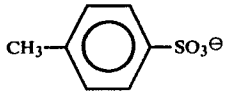 | 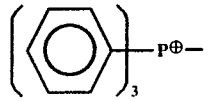 | — | 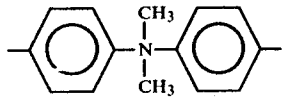 | — | 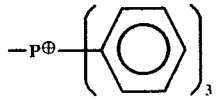 | 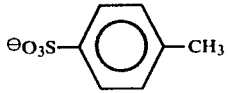 |

TABLE 1-continued

| No. | $(A_1)^{\ominus}$ | $X_1^{\oplus}$ | $Y_1$ | Z | $Y_2$ | $X_2^{\oplus}$ | $(A_2)^{\ominus}$ |
|---|---|---|---|---|---|---|---|
| 100 | $Br^{\ominus}$ | 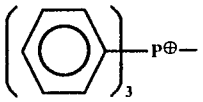 | $-CH_2-$ | 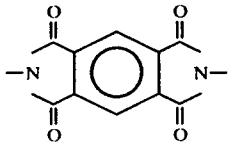 | $-CH_2-$ | 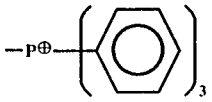 | $Br^{\ominus}$ |
| 101 | $Br^{\ominus}$ | 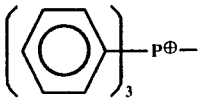 | $-CH_2-$ | 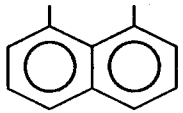 | $-CH_2-$ | 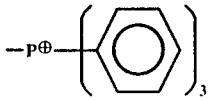 | $Br^{\ominus}$ |
| 102 | $SbF_6^{\ominus}$ | 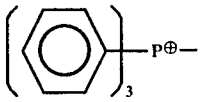 | $-CH_2-$ | 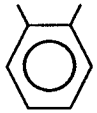 | $-CH_2-$ | 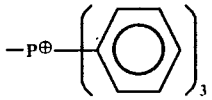 | $SbF_6^{\ominus}$ |
| 103 | $PF_6^{\ominus}$ | 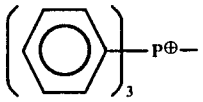 | $-CH_2-$ | 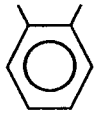 | $-CH_2-$ | 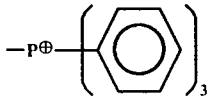 | $PF_6^{\ominus}$ |
| 104 | $I^{\ominus}$ | 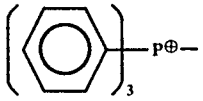 | $-CH_2-$ | 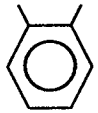 | $-CH_2-$ | 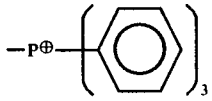 | $I^{\ominus}$ |
| 105 | $I^{\ominus}$ | 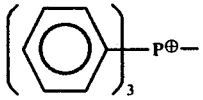 | $-CH_2-$ | 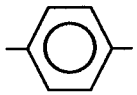 | $-CH_2-$ | 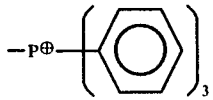 | $I^{\ominus}$ |
| 106 | $SbF_6^{\ominus}$ | 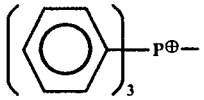 | $-CH_2-$ | 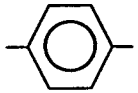 | $-CH_2-$ | 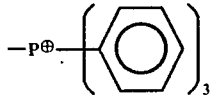 | $SbF_6^{\ominus}$ |
| 107 | $PF_6^{\ominus}$ | 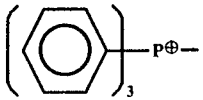 | $-CH_2-$ | 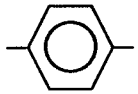 | $-CH_2-$ | 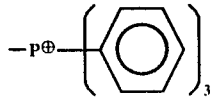 | $PF_6^{\ominus}$ |

The above-described compounds can be prepared by the conventional process, for example, by reacting a triorganophosphine with an organodihalide. In the formed phosphonium salt, the anion may be replaced by other anion by the conventional process.

Synthetic Examples of the compounds of the present invention represented by the formula (1) will now be described. In the Synthetic Examples, "parts" are "parts by weight" unless otherwise specified.

SYNTHETIC EXAMPLE 1

5.3 parts of $\alpha,\alpha'$-o-xylylene dibromide was dissolved in 100 parts of acetonitrile and 10.5 parts of triphenylphosphine was added thereto. The mixture was heated under reflux for 3 hr. Crystals of a phosphonium salt began to precipitate in about 20 min. The mixture was allowed to stand for cooling and diluted with a small amount of diethyl ether. The solid matter was collected by filtration and washed with a small amount of acetonitrile to obtain 13.5 parts of o-xylylenebis-(triphenylphosphonium bromide) (compound No. 88 in Table 1) (m.p. > 300° C.).

SYNTHETIC EXAMPLE 2

10 parts by weight of o-xylylenebis(triphenylphosphonium bromide) prepared in Synthetic Example 1 was dissolved in 60 parts of methanol. The resultant solution was added dropwise to 500 parts of a 3% aqueous sodium tetrafluoroborate solution, and the precipitated crystal was collected by filtration to obtain 8.2 parts of o-xylylenebis(triphenylphosphonium tetrafluoroborate) (compound No. 92 in Table 1).

SYNTHETIC EXAMPLE 3

[A]

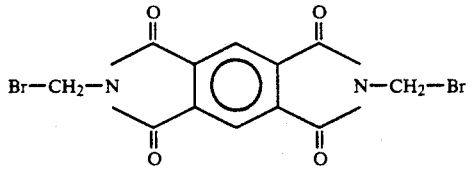

6.0 parts of the compound of the above-described formula [A] was dissolved in 100 parts of acetonitrile and 11.0 parts of tri-n-octylphosphine was added thereto. The mixture was heated under reflux for 5 hr, allowed to stand for cooling and treated in the same manner as that of Synthetic Example 1 to obtain 12.5 parts of the compound No. 4.

SYNTHETIC EXAMPLE 4

An anion exchange was conducted in the same manner as that of Synthetic Example 2 through the use of 10.0 parts of the compound No. 4 prepared in the Synthetic Example 3 and ammonium molybdate, thereby obtaining 8.9 parts by weight of the compound No. 3.

SYNTHETIC EXAMPLE 5

[B]

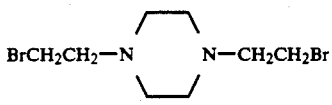

4.5 parts of the compound represented by the above-described formula [B] was dissolved in 100 parts of acetonitrile and 3.9 parts of triphenylphosphine was added thereto. Further 4.6 parts of tri(4-methylphenyl)-phosphine was added thereto, and the mixture was heated under reflux for 5 hr. The reaction mixture was allowed to stand for cooling and treated in the same manner as that of Synthetic Example 1 to obtain 12.5 parts of the compound No. 62.

A toner containing the compound represented by the above-described formula (1) can be prepared by a process which comprises kneading a mixture of the compound of the formula (1), a colorant and a binder resin in an apparatus capable of conducting heat mixing, such as a heat kneader and a twin roll, in such a state that the binder resin is in a molten state, cooling the kneaded product for solidification and pulverizing the solid into particles having a diameter of 1 to 30 μm by means of a pulverizer such as a jet mill and a ball mill. A process which comprises dissolving a colorant, a binder and the compound represented by the formula (1) in a solvent such as acetone and ethyl acetate, stirring the resultant solution, pouring the solution into water for reprecipitation, subjecting the precipitate to filtration and drying, pulverizing the dried solid into particles having a diameter of 1 to 30 μm by means of a pulverizer such as a ball mill, is also applicable. In general, the proportion of the binder resin is 99 to 65% (by weight; the same shall apply hereinafter), preferably 98 to 85%, the proportion of the colorant is 1.0 to 15%, preferably 1.5 to 10%, and the proportion of the charge control agent is 0.1 to 30%, preferably 0.5 to 5%.

Examples of the colorant useable in the electrophotographic toner of the present invention include colorants known in the art, for example, inorganic pigments such as carbon black and ultramarine; organic pigments such as C.I. (abbreviation for Color Index; the same shall apply hereinafter) Pigment Yellow 1, C.I. Pigment Red 9 and C.I. Pigment Blue 15 and oil-soluble dyes such as C.I. Solvent Yellow 93, C.I. Solvent Red 146, C.I. Solvent Blue 35, C.I. Disperse Yellow 42, C.I. Disperse Red 59 and C.I. Disperse Blue 81. Examples of the binder resin include polystyrene, a styreneacrylic acid copolymer, a styrene-propylene copolymer, a styrene-acrylonitrile copolymer, an acrylic resin, a styrene-maleic acid copolymer, a polyvinyl chloride, a polyvinyl acetate, an olefin resin, a polyester resin, a polyurethane resin and an epoxy resin. They may be used alone or in the form of a mixture thereof.

The electrophotographic toner of the present invention may be blended with optional additives, for example, fluidizers such as silicon oxide, anti-foggants such as mineral oils, various magnetic materials for one-component development, and conductive agents such as zinc oxide.

The toner prepared in the present invention is mixed with, for example, an about 200-mesh iron powder (carrier) in a weight ratio of the toner to the iron powder of, for example, (3 to 8):(97 to 92) to prepare a developer for use in the step of development in the electrophotography.

Compared with toners wherein a conventional charge control agent is used, the electrophotographic toner of the present invention has a sharp distribution of the amount of electrification and a good time stability and therefore is characterized by a high capability of providing an image having a very high gradation and a very high capability of repeatedly forming an image.

The present invention will now be described in more detail by referring to the following Examples, though it is not limited to these Examples only.

In the Examples, "parts" are "parts by weight" unless otherwise specified.

EXAMPLE 1

| | |
|---|---|
| styrene-butyl acrylate copolymer (binder) | 100 parts |
| low molecular-weight polyethylene | 3 parts |
| C.I. disperse Yellow 164 (colorant) | 1.2 parts |
| compound No. 88 | 1.5 parts |

A mixture having the above-described composition was subjected to a melt mixing treatment (for 10 min) in a kneader adjusted to a temperature from 120° to 140° C. and then cooled for solidification.

The solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the iron powder carrier of 3:97 to prepare developer A. The developer A was then subjected to measurement of an initial specific electrification amount by means of a blow-off electrification amount measuring apparatus and found to be +21.0 μc/g. Further, the developer A was used for copying in a copying machine to give a clear yellow image having an excellent gradation without detrimental to the hue inherent in the colorant.

Further, the developer A was subjected to the time stability test (a test for change in the amount of electrification with time and a test for change in the amount of electrification under a moist condition). The results are given in the following Table 2.

TABLE 2

| | Test for change in the amount of electrification with time (unit: +μc/g) (hr) | | | | | |
|---|---|---|---|---|---|---|
| | 0.25 | 0.5 | 1 | 2 | 4 | 6 |
| Developer A | 21.0 | 22.5 | 21.3 | 20.9 | 20.5 | 20.4 |

| Test for change in the amount of electrification under moist condition (unit: +μc/g) | | |
|---|---|---|
| initial | after one week | attenuation (%) |
| 21.0 | 20.1 | 4.2 |

As is apparent from the above-described results, the developer A had a very excellent time stability.

The time stability test was conducted by the following methods.

Test for Change in the Amount of Electrification with Time

A developer (a mixture of a toner with an iron powder carrier) A was weighed into a polyethylene vessel and subjected to ball milling at 100 rpm for 6 hr, thereby conducting contact electrification. At that time, the amount of electrification of the toner was measured at predetermined time intervals.

Test for Change in the Amount of Electrification Under Moist Condition

The toner was electrified for one hour in a polyethylene vessel in the same manner as that described above, and the polyethylene vessel was allowed to stand in an open state for one week in an atmosphere at a temperature of 35° C. and a humidity of 90% to measure the amount of electrification of the toner.

EXAMPLE 2

| | |
|---|---|
| polyester resin (binder) | 100 parts |
| carbon black (colorant) | 6.0 parts |
| compound No. 93 | 1.5 parts |

A mixture having the above-described composition was subjected to a melt mixing treatment for 10 min) in a kneader at a temperature adjusted to 120° to 140° C. and then cooled for solidification. The solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the powder carrier in a weight ratio of the toner to the iron powder carrier of 3:97 to prepare developer B. The developer B was then subjected to measurement of an initial specific electrification amount by means of a blow-off electrification amount measuring apparatus and found to be +32.1 μc/g. Further, the developer B was used for copying in a copying machine to give a black image having an excellent gradation.

Further, the developer B was subjected to the time stability test in the same manner as that of Example 1. The results are given in the following Table 3.

TABLE 3

| | Test for change in the amount of electrification with time (unit: +μc/g) (hr) | | | | | |
|---|---|---|---|---|---|---|
| | 0.25 | 0.5 | 1 | 2 | 4 | 6 |
| Developer B | 32.1 | 32.4 | 31.9 | 31.7 | 31.6 | 31.2 |

| Test for change in the amount of electrification under moist condition (unit: +μc/g) | | |
|---|---|---|
| initial | after one week | attenuation (%) |
| 32.1 | 31.1 | 3.1 |

As is apparent from the above-described results, the developer B had a very excellent time stability.

EXAMPLE 3

| | |
|---|---|
| styrene-methyl acrylate copolymer (binder) | 100 parts |
| low-molecular-weight polypropylene | 3 parts |
| C.I. Solvent Blue 111 (colorant) | 1.5 parts |
| compound No. 13 | 1.5 parts |

A mixture of these compounds was dissolved in 1000 parts of a solvent mixture of acetone and ethyl acetate, and the solution was stirred at room temperature for one hour. Then, the stirred mixture was added dropwise to 10,000 parts of water while stirring for reprecipitation. The formed precipitates were collected by filtration and dried to prepare a toner in the coarse particle form. Subsequently, the toner was pulverized by means of a jet mill pulverizer and then classified by means of an air classifier to prepare a toner having a particle diameter of 5 to 20 μm. The toner thus prepared was mixed with an about 200-mesh iron powder carrier in a weight ratio of the toner to the iron powder carrier of 3:97 to prepare developer C. The developer C was then subjected to measurement of an initial specific electrification amount by means of a blow-off electrification amount measuring apparatus and found to be +20.8 μc/g. Further, the developer C was used for copying in a copying machine to give a clear blue image having an excellent gradation without detriment to the hue inherent in the colorant.

Further, the developer C was subjected to the time stability test in the same manner as that of Example 1. The results are given in the following Table 4.

TABLE 4

| | Test for change in the amount of electrification with time (unit: +μc/g) (hr) | | | | | |
|---|---|---|---|---|---|---|
| | 0.25 | 0.5 | 1 | 2 | 4 | 6 |
| Developer C | 20.8 | 22.4 | 21.5 | 21.1 | 20.6 | 19.9 |

| Test for change in the amount of electrification under moist condition (unit: +μc/g) | | |
|---|---|---|
| initial | after one week | attenuation (%) |
| 20.7 | 19.6 | 5.3 |

As is apparent from the above-described results, the developer C had a very excellent time stability.

EXAMPLE 4

| | |
|---|---|
| epoxy resin (binder) | 100 parts |
| C.I. Disperse Red 60 (colorant) | 1.2 parts |
| C.I. Disperse Violet 17 (colorant) | 0.3 parts |
| compound No. 28 | 2.0 parts |

A mixture having the above-described composition was subjected to a melt mixing treatment in a kneader at a temperature adjusted to 110° to 130° C. and then spontaneously cooled for solidification. The solid was coarsely crushed by means of a coarse crusher, pulverized by means of a jet mill pulverizer and further classified by means of an air classifier to prepare a toner having a particle diameter of 5 to 20 μm.

100 parts of the toner thus prepared was mixed with 0.3 part of a colloidal silica in a Henschel mixer. The mixture was then mixed with an about 200-mesh iron powder carrier in a weight ratio of the toner to the iron powder carrier of 3:97 to prepare developer D. The developer D was then subjected to measurement of an initial specific electrification amount by means of a blow-off electrification amount measuring apparatus and found to be +25.1 μc/g. Further, the developer D was used for copying in a copying machine to give a clear red image having an excellent gradation without detriment to the hue inherent in the colorant.

Further, the developer D was subjected to the time stability test in the same manner as that of Example 1. The results are given in the following Table 5.

TABLE 5

| | Test for change in the amount of electrification with time (unit: +μc/g) (hr) | | | | | |
|---|---|---|---|---|---|---|
| | 0.25 | 0.5 | 1 | 2 | 4 | 6 |
| Developer D | 25.1 | 26.9 | 26.3 | 25.9 | 25.8 | 25.7 |

| Test for change in the amount of electrification under moist condition (unit: +μc/g) | | |
|---|---|---|
| initial | after one week | attenuation (%) |
| 25.2 | 24.9 | 1.2 |

As is apparent from the above-described results, the developer D had a very excellent time stability.

EXAMPLE 5

| | |
|---|---|
| epoxy resin (binder) | 100 parts |
| C.I. Disperse Red 60 (colorant) | 1.2 parts |
| C.I. Disperse Violet 17 (colorant) | 0.3 parts |
| compound No. 38 | 2.0 parts |

A mixture having the above-described composition was subjected to a melt mixing treatment in a kneader at a temperature adjusted to 100° C. and then spontaneously cooled for solidification. The solid was coarsely crushed by means of a coarse crusher, pulverized by means of a jet mill pulverizer and further classified by means of an air classifier to prepare a toner having a particle diameter of 5 to 20 μm.

100 parts of the toner thus prepared was mixed with 0.3 part of a colloidal silica in a Henschel mixer. The mixture was then mixed with an about 200-mesh iron powder carrier in a weight ratio of the toner to the iron powder carrier of 3:97 to prepare developer E. The developer E was then subjected to measurement of an initial specific electrification amount by means of a blow-off electrification amount measuring apparatus and found to be +19 1 μc/g. Further, the developer E was used for copying in a copying machine to give a clear red image having an excellent gradation without detriment to the hue inherent in the colorant.

Further, the developer E was subjected to the time stability test in the same manner as that of Example 1. The results are given in the following Table 6.

TABLE 6

| | Test for change in the amount of electrification with time (unit: +μc/g) (hr) | | | | | |
|---|---|---|---|---|---|---|
| | 0.25 | 0.5 | 1 | 2 | 4 | 6 |
| Developer E | 19.1 | 19.8 | 19.5 | 19.8 | 18.7 | 18.3 |

| Test for change in the amount of electrification under moist condition (unit: +μc/g) | | |
|---|---|---|
| initial | after one week | attenuation (%) |
| 19.0 | 18.2 | 4.2 |

As is apparent from the above-described results, the developer E had a very excellent time stability.

EXAMPLE 6

| | |
|---|---|
| styrene-butyl acrylate copolymer (binder) | 100 parts |
| low-molecular-weight polyethylene | 3 parts |
| Kayaset Yellow 963 (colorant) (a product of Nippon Kayaku Co., Ltd.) | 1.2 parts |
| compound No. 86 | 1.5 parts |

A mixture having the above-described composition was subjected to a melt mixing treatment (for 10 min) in a kneader at a temperature adjusted to 140° C. and then cooled for solidification. The solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the iron powder carrier of 3:97 to prepare developer F. The developer F was then subjected to measurement of an initial specific electrification amount by means of a blow-off electrification amount measuring apparatus and found to be +21.7 μc/g. Further, the developer F was used for copying in a copying machine to give a clear yellow image having an excellent gradation without detriment to the hue inherent in the colorant.

Further, the developer F was subjected to the time stability test (a test for change in the amount of electrification with time and a test for change in the amount of electrification under a moist condition). The results are given in the following Table 7.

TABLE 7

| | Test for change in the amount of electrification with time (unit: +μc/g) (hr) | | | | | |
|---|---|---|---|---|---|---|
| | 0.25 | 0.5 | 1 | 2 | 4 | 6 |
| Developer F | 21.7 | 22.4 | 21.9 | 21.6 | 21.6 | 21.3 |

| Test for change in the amount of electrification under moist condition (unit: +μc/g) | | |
|---|---|---|
| initial | after one week | attenuation (%) |
| 21.7 | 21.2 | 2.3 |

As is apparent from the above-described results, the developer F had a very excellent time stability.

EXAMPLES 7 TO 76

Developers were prepared in the same manner as that of Example 1 through the use of compounds listed in the column of "Compound" and colorants listed in the column of "Colorant" of tables 8 to 13, and the formed toners were each subjected to measurement of an initial specific electrification amount and the time stability test in the same manner as that of Example 1.

As a result, it was found that the toners wherein use was made of any of the compounds exhibited less susceptibility to a change in the amount of electrification and the developers had a very excellent time stability. Copying was conducted by means of a copying machine to give a result wherein all of the developers provided a clear image having an excellent gradation and the hue inherent in the colorant.

TABLE 8

| Ex. No. | Compd. No. | Colorant | Test for change in amount of electrification with time (unit: +μc/g) (hr) 0.25 | 0.5 | 1 | 2 | 4 | 6 | Test for change in the amount of electrification under moist condition (unit: +μc/g) initial | after one week | attenuation (%) |
|---|---|---|---|---|---|---|---|---|---|---|---|
| 7 | 3 | C.I. Dis. Y. 164 | 18.2 | 18.9 | 18.7 | 18.7 | 18.5 | 17.9 | 18.2 | 17.8 | 2.2 |
| 8 | 4 | C.I. Dis. Y. 164 | 17.8 | 18.3 | 18.0 | 17.5 | 17.4 | 17.2 | 17.8 | 17.0 | 4.5 |
| 9 | 5 | C.I. Dis. Y. 164 | 16.9 | 17.5 | 17.3 | 17.3 | 17.0 | 16.5 | 16.9 | 16.1 | 4.7 |
| 10 | 6 | C.I. Dis. Y. 164 | 20.1 | 20.9 | 20.5 | 20.1 | 20.0 | 20.0 | 20.1 | 19.1 | 5.0 |
| 11 | 7 | C.I. Dis. Y. 164 | 20.8 | 22.3 | 21.1 | 20.8 | 20.2 | 19.8 | 20.7 | 19.5 | 5.8 |
| 12 | 8 | C.I. Pig. Y. 1 | 19.9 | 20.5 | 20.4 | 19.7 | 19.5 | 19.1 | 19.8 | 18.9 | 4.5 |
| 13 | 9 | C.I. Pig. Y. 1 | 26.6 | 27.2 | 26.9 | 26.0 | 26.0 | 25.7 | 26.4 | 26.2 | 0.7 |
| 14 | 14 | C.I. Pig. Y. 1 | 23.1 | 24.0 | 24.2 | 23.5 | 23.3 | 23.0 | 23.3 | 23.0 | 1.3 |
| 15 | 15 | C.I. Pig. Y. 1 | 25.3 | 25.9 | 25.7 | 25.2 | 25.2 | 25.0 | 25.3 | 24.8 | 2.0 |
| 16 | 19 | Kayaset Y. 963 | 21.5 | 22.1 | 22.1 | 21.3 | 20.9 | 20.5 | 21.7 | 21.1 | 2.8 |

[colorant] C.I.: Color Index, Sol: Solvent, Dis: Disperse, PIG: Pigment, B: Blue, R: Red, Y: Yellow
Kayaset is a trade name of a product of Nippon Kayaku Kabushiki Kaisha.

TABLE 9

| Ex. No. | Compd. No. | Colorant | Test for change in amount of electrification with time (unit: +μc/g) (hr) 0.25 | 0.5 | 1 | 2 | 4 | 6 | Test for change in the amount of electrification under moist condition (unit: +μc/g) initial | after one week | attenuation (%) |
|---|---|---|---|---|---|---|---|---|---|---|---|
| 17 | 20 | Kayaset Y. 963 | 19.9 | 20.4 | 20.2 | 20.1 | 19.9 | 19.8 | 19.7 | 19.6 | 0.5 |
| 18 | 23 | Kayaset Y. 963 | 27.7 | 28.4 | 27.6 | 27.6 | 26.9 | 26.9 | 27.7 | 27.6 | 0.4 |
| 19 | 24 | Kayaset Y. 963 | 18.8 | 19.5 | 19.2 | 18.5 | 18.3 | 18.1 | 18.8 | 17.9 | 4.8 |
| 20 | 25 | Kayaset Y. 963 | 20.3 | 21.5 | 21.2 | 20.7 | 20.1 | 19.8 | 20.3 | 19.5 | 3.9 |
| 21 | 26 | Kayaset Y. 963 | 18.9 | 19.1 | 19.0 | 18.7 | 18.5 | 18.5 | 18.8 | 18.2 | 3.2 |
| 22 | 29 | Kayaset Y. 963 | 18.2 | 18.8 | 18.7 | 18.6 | 18.4 | 18.2 | 18.1 | 17.8 | 1.7 |
| 23 | 31 | carbon black | 19.3 | 21.3 | 21.0 | 20.0 | 20.5 | 20.8 | 19.2 | 18.7 | 2.6 |
| 24 | 34 | carbon black | 19.1 | 19.4 | 19.0 | 19.3 | 19.2 | 19.1 | 19.0 | 18.8 | 1.1 |

TABLE 9-continued

| Ex. No. | Compd. No. | Colorant | Test for change in amount of electrification with time (unit: +μc/g) (hr) 0.25 | 0.5 | 1 | 2 | 4 | 6 | Test for change in the amount of electrification under moist condition (unit: +μc/g) initial | after one week | attenuation (%) |
|---|---|---|---|---|---|---|---|---|---|---|---|
| 25 | 35 | carbon black | 22.9 | 23.2 | 22.5 | 22.4 | 21.8 | 21.5 | 22.7 | 22.0 | 3.1 |
| 26 | 36 | carbon black | 23.7 | 24.1 | 23.9 | 23.8 | 23.5 | 23.4 | 23.5 | 23.3 | 0.9 |
| 27 | 37 | carbon black | 18.1 | 18.5 | 18.3 | 17.9 | 17.5 | 17.3 | 18.0 | 17.2 | 4.4 |

TABLE 10

| Ex. No. | Compd. No. | Colorant | Test for change in amount of electrification with time (unit: +μc/g) (hr) 0.25 | 0.5 | 1 | 2 | 4 | 6 | Test for change in the amount of electrification under moist condition (unit: +μc/g) initial | after one week | attenuation (%) |
|---|---|---|---|---|---|---|---|---|---|---|---|
| 28 | 39 | carbon black | 17.9 | 18.8 | 18.7 | 18.4 | 18.3 | 18.2 | 18.0 | 17.5 | 2.8 |
| 29 | 40 | C.I. Sol. B. 111 | 26.2 | 26.5 | 26.1 | 26.0 | 25.6 | 25.5 | 26.1 | 25.4 | 2.7 |
| 30 | 42 | C.I. Sol. B. 111 | 20.1 | 20.6 | 20.3 | 20.0 | 19.5 | 19.4 | 20.1 | 19.7 | 2.0 |
| 31 | 43 | C.I. Sol. B. 111 | 18.3 | 19.0 | 18.2 | 17.5 | 17.4 | 17.2 | 18.2 | 17.1 | 6.0 |
| 32 | 44 | C.I. Sol. B. 111 | 23.3 | 24.2 | 23.8 | 23.1 | 22.8 | 22.5 | 23.2 | 22.1 | 4.7 |
| 33 | 47 | C.I. Sol. B. 111 | 17.9 | 18.7 | 18.6 | 17.2 | 17.1 | 17.0 | 17.9 | 17.0 | 5.0 |
| 34 | 48 | C.I. Dis. B. 81 | 18.0 | 18.3 | 18.2 | 18.5 | 18.1 | 17.6 | 18.1 | 17.4 | 3.9 |
| 35 | 50 | C.I. Dis B. 81 | 18.2 | 18.5 | 18.1 | 18.0 | 17.5 | 17.3 | 18.0 | 17.2 | 4.4 |
| 36 | 51 | C.I. Dis. B. 81 | 21.7 | 22.4 | 22.3 | 21.8 | 21.4 | 21.1 | 21.5 | 21.0 | 2.3 |
| 37 | 52 | C.I. Dis. B. 81 | 19.2 | 19.9 | 19.5 | 19.1 | 18.7 | 18.3 | 19.2 | 18.1 | 5.5 |
| 38 | 56 | C.I. Dis. B. 81 | 21.0 | 22.1 | 21.7 | 21.3 | 20.8 | 20.4 | 21.0 | 20.2 | 3.8 |

TABLE 11

| Ex. No. | Compd. No. | Colorant | Test for change in amount of electrification with time (unit: +μc/g) (hr) 0.25 | 0.5 | 1 | 2 | 4 | 6 | Test for change in the amount of electrification under moist condition (unit: +μc/g) initial | after one week | attenuation (%) |
|---|---|---|---|---|---|---|---|---|---|---|---|
| 39 | 57 | C.I. Sol. B. 35 | 17.8 | 17.9 | 17.6 | 17.1 | 16.9 | 16.8 | 17.5 | 16.2 | 7.4 |
| 40 | 60 | C.I. Sol. B. 35 | 18.1 | 18.7 | 18.4 | 18.0 | 17.8 | 17.5 | 18.1 | 17.8 | 1.7 |
| 41 | 62 | C.I. Sol. B. 35 | 19.1 | 20.8 | 20.3 | 19.5 | 19.3 | 19.2 | 19.9 | 18.1 | 4.7 |
| 42 | 63 | C.I. Sol. B. 35 | 17.8 | 18.4 | 18.3 | 18.0 | 17.5 | 17.3 | 17.8 | 17.0 | 4.5 |
| 43 | 64 | C.I. Sol. B. 35 | 31.9 | 32.1 | 31.1 | 30.5 | 29.6 | 29.1 | 31.7 | 29.5 | 6.9 |
| 44 | 65 | C.I. Sol. B. 35 | 20.9 | 21.3 | 21.3 | 21.2 | 20.9 | 20.7 | 20.5 | 20.0 | 2.4 |
| 45 | 66 | C.I. Sol. B. 35 | 18.7 | 19.4 | 19.2 | 18.7 | 18.3 | 18.2 | 18.7 | 17.8 | 4.8 |
| 46 | 68 | C.I. Sol. B. 35 | 16.9 | 17.8 | 17.6 | 17.5 | 17.3 | 17.1 | 16.9 | 16.0 | 5.3 |
| 47 | 69 | C.I. Sol. B. 35 | 16.5 | 16.9 | 16.8 | 16.3 | 16.0 | 15.7 | 16.5 | 15.4 | 6.7 |
| 48 | 72 | C.I. Dis. R. 60 | 25.3 | 25.9 | 25.1 | 24.5 | 24.2 | 24.0 | 25.3 | 24.7 | 2.4 |
| 49 | 75 | C.I. Dis. R. 60 | 22.4 | 23.5 | 23.1 | 22.8 | 22.2 | 21.9 | 22.4 | 21.3 | 4.9 |

TABLE 12

| Ex. No. | Compd. No. | Colorant | Test for change in amount of electrification with time (unit: +μc/g) (hr) 0.25 | 0.5 | 1 | 2 | 4 | 6 | Test for change in the amount of electrification under moist condition (unit: +μc/g) initial | after one week | attenuation (%) |
|---|---|---|---|---|---|---|---|---|---|---|---|
| 50 | 76 | C.I. Dis. R. 60 | 19.4 | 19.9 | 19.8 | 19.9 | 19.5 | 19.0 | 19.2 | 18.6 | 3.1 |
| 51 | 78 | C.I. Dis. R. 60 | 18.9 | 19.7 | 19.7 | 19.4 | 18.7 | 18.1 | 18.9 | 18.0 | 4.8 |
| 52 | 79 | C.I. Dis. R. 60 | 17.8 | 18.9 | 18.2 | 17.3 | 17.2 | 16.7 | 17.8 | 16.3 | 8.4 |
| 53 | 81 | C.I. Pig. R. 146 | 21.5 | 22.3 | 22.0 | 21.8 | 21.1 | 21.0 | 21.5 | 20.8 | 3.3 |
| 54 | 82 | C.I. Pig. R. 146 | 21.0 | 22.5 | 22.2 | 21.8 | 20.9 | 21.0 | 21.0 | 20.2 | 3.8 |
| 55 | 83 | C.I. Pig. R. 146 | 18.1 | 18.8 | 18.5 | 17.6 | 17.3 | 17.1 | 18.0 | 17.3 | 3.9 |
| 56 | 84 | C.I. Pig. R. 146 | 16.9 | 17.8 | 17.7 | 17.1 | 16.8 | 16.7 | 16.9 | 15.9 | 5.9 |
| 57 | 85 | C.I. Dis. R. 146 | 18.2 | 18.9 | 18.7 | 18.5 | 18.0 | 17.6 | 18.2 | 17.3 | 4.9 |
| 58 | 87 | C.I. Pig. R. 9 | 20.8 | 22.3 | 21.8 | 21.1 | 20.3 | 19.8 | 20.8 | 19.2 | 7.7 |
| 59 | 89 | C.I. Pig. R. 9 | 19.7 | 20.4 | 20.1 | 19.5 | 19.1 | 19.0 | 19.7 | 18.6 | 5.6 |
| 60 | 90 | C.I. Pig. R. 9 | 16.9 | 17.8 | 17.4 | 17.2 | 16.5 | 16.1 | 16.9 | 15.8 | 6.5 |

TABLE 13

| Ex. No. | Compd. No. | Colorant | Test for change in amount of electrification with time (unit: +μc/g) (hr) 0.25 | 0.5 | 1 | 2 | 4 | 6 | Test for change in the amount of electrification under moist condition (unit: +μc/g) initial | after one week | attenuation (%) |
|---|---|---|---|---|---|---|---|---|---|---|---|
| 61 | 91 | C.I. Pig. R. 9 | 18.2 | 19.3 | 19.0 | 18.5 | 18.1 | 17.6 | 18.2 | 17.5 | 3.8 |
| 62 | 92 | C.I. Pig. R. 9 | 21.5 | 22.8 | 22.0 | 21.8 | 21.5 | 21.4 | 21.5 | 20.3 | 5.6 |
| 63 | 94 | C.I. Sol. R. 146 | 22.8 | 23.9 | 23.5 | 23.0 | 22.5 | 22.1 | 22.8 | 22.0 | 3.5 |
| 64 | 95 | C.I. Sol. R. 146 | 28.9 | 29.8 | 29.7 | 29.1 | 28.8 | 28.5 | 28.9 | 28.3 | 2.1 |
| 65 | 96 | C.I. Sol. R. 146 | 24.7 | 26.1 | 25.8 | 25.4 | 25.2 | 25.0 | 24.7 | 24.1 | 2.4 |
| 66 | 97 | C.I. Sol. R. 146 | 20.5 | 21.8 | 21.4 | 20.6 | 20.4 | 20.1 | 20.4 | 19.1 | 6.4 |
| 67 | 98 | C.I. Sol. R. 146 | 29.7 | 30.5 | 30.2 | 29.6 | 29.3 | 28.9 | 29.7 | 28.8 | 3.0 |
| 68 | 99 | C.I. Pig. R. 146 | 21.1 | 22.7 | 22.3 | 21.8 | 21.2 | 20.9 | 21.0 | 20.5 | 2.4 |
| 69 | 100 | C.I. Sol. R. 146 | 28.8 | 29.7 | 29.5 | 29.0 | 28.9 | 28.7 | 28.8 | 27.9 | 3.1 |
| 70 | 101 | C.I. Sol. R. 146 | 22.3 | 23.9 | 23.7 | 23.1 | 22.8 | 22.6 | 22.3 | 21.0 | 5.8 |
| 71 | 102 | C.I. Dis B. 81 | 24.6 | 23.6 | 23.7 | 24.0 | 24.2 | 22.0 | 24.6 | 23.1 | 6.1 |
| 72 | 103 | C.I. Dis B. 81 | 13.8 | 14.6 | 15.3 | 12.7 | 10.5 | 9.2 | 13.8 | 12.9 | 6.5 |
| 73 | 104 | C.I. Dis B. 35 | 20.1 | 19.0 | 18.8 | 18.7 | 18.1 | 17.8 | 20.1 | 19.3 | 4.0 |
| 74 | 105 | C.I. Dis B. 81 | 18.3 | 16.8 | 16.5 | 16.3 | 15.3 | 15.6 | 18.3 | 17.0 | 7.1 |
| 75 | 106 | C.I. Dis B. 81 | 22.3 | 21.8 | 21.7 | 22.0 | 22.1 | 20.0 | 22.3 | 21.4 | 4.0 |
| 76 | 107 | C.I. Dis R. 60 | 12.5 | 12.2 | 13.1 | 11.7 | 10.1 | 10.3 | 12.5 | 11.7 | 6.4 |

What is claimed is:

1. An electrophotographic toner containing at least one compound represented by the following formula (1):

$$(A_1)^{\ominus}X_1^{\oplus}-Y_1-Z-Y_2-X_2^{\oplus}(A_2)^{\ominus} \quad (1)$$

wherein $X_1^{\oplus}$ and $X_2^{\oplus}$ independently represent

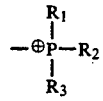

wherein $R_1$, $R_2$ and $R_3$ independently represent a substituted or unsubstituted alkyl group, a substituted or unsubstituted cycloalkyl group, a substituted or unsubstituted alkenyl group, a substituted or unsubstituted alkynyl group, a substituted or unsubstituted aryl group or a substituted or unsubstituted aralkyl group, and $R_1$ and $R_2$ may combine together to represent a divalent group, $Y_1$ and $Y_2$ independently represent a direct bond, an alkylene group having 1 to 10 carbon atoms or an alkenylene group having 3 to 10 carbon atoms, Z represents a divalent aromatic group; a divalent heterocyclic group; —$NR_4$— or —$N(R_4)CO$— wherein $R_4$ represents a hydrogen atom, a substituted or unsubstituted alkyl group, a substituted or unsubstituted aryl group or a substituted or unsubstituted aralkyl group; —O—; or —$OCH_2CH_2O$—, and $(A_1)^{\ominus}$ and $(A_2)^{\oplus}$ independently represent $I^{\ominus}$, $BF_4^{\ominus}$, $PF_6^{\ominus}$ or $MoO_{4/2}^{\ominus}$.

2. An electrophotographic toner according to claim 1, wherein $(A_1)^{\ominus}$ is identical with $(A_2)^{\ominus}$, $(X_1)^{\oplus}$ is identical with $(X_2)^{\oplus}$, and $Y_1$ is identical with $Y_2$.

3. An electrophotographic toner according to claim 1, wherein toner particles comprise a binder resin, a colorant and the compound represented by the formula (1) in a respective amount effective for electrophotography.

4. An electrophotographic toner according to claim 1, which further contains in admixture a carrier.

5. An electrophotographic toner according to claim 1, wherein $R_1$, $R_2$ and $R_3$ independently represent a substituted or unsubstituted $C_1$–$C_{12}$ alkyl group, a substituted or unsubstituted $C_6$ cycloalkyl group, a substituted or unsubstituted $C_3$–$C_4$ alkenyl group, a substituted or unsubstituted $C_2$–$C_4$ alkynyl group, a substituted or unsubstituted aryl group selected from the group consisting of phenyl and naphthyl, and a substituted or unsubstituted aralkyl group selected from the group consisting of benzyl, a-methylbenzyl, diphenylmethyl and phenethyl, and $R_1$ and $R_2$ may combine together to represent a divalent group selected from the group consisting of a $C_5$ alkylene group and a biphenylene group, the substituent for said alkyl group, cycloalkyl group, alkenyl group, alkynyl group, aryl group and aralkyl group being selected from the group consisting of a $C_1$–$C_4$ alkoxy group, an aryloxy group, an amino group, a di($C_1$–$C_4$ alkyl)amino group, a $C_1$–$C_4$ alkyl group, a halogen atom, an aryl group, a hydroxyl group and a cyano group.

6. An electrophotographic toner according to claim 1, wherein $(A_1)^{\ominus}$ and $(A_2)^{\ominus}$ independently represent an electrophotographically acceptable anion.

* * * * *